United States Patent [19]

Tanahashi

[11] Patent Number: 4,519,479

[45] Date of Patent: May 28, 1985

[54] SAFETY APPARATUS FOR ELEVATOR

[75] Inventor: Toru Tanahashi, Gifu, Japan

[73] Assignee: Mitsubishi Denki Kabushiki Kaisha, Tokyo, Japan

[21] Appl. No.: 619,911

[22] Filed: Jun. 12, 1984

[30] Foreign Application Priority Data

Jun. 15, 1983 [JP] Japan ..... 58-107188

[51] Int. Cl.[3] ..... B66B 5/06

[52] U.S. Cl. ..... 187/29 R; 318/453

[58] Field of Search ..... 187/29; 318/317, 449, 318/450, 453, 476

[56] References Cited

U.S. PATENT DOCUMENTS

| | | | |
|---|---|---|---|
| 3,961,688 | 6/1976 | Maynard | 187/29 R |
| 4,378,059 | 3/1983 | Hatakeyama et al. | 187/29 R |
| 4,394,607 | 7/1983 | Lemirande | 318/453 |

*Primary Examiner*—B. Dobeck

*Assistant Examiner*—W. E. Duncanson, Jr.

*Attorney, Agent, or Firm*—Leydig, Voit, Osann, Mayer and Holt, Ltd.

[57] ABSTRACT

In an elevator having a converter which changes an A.C. output from an A.C. power source into a D.C. output, an inverter which changes the D.C. output of the converter into an A.C. output, a current detector which detects an output current of the inverter, and an inverter controller which controls the inverter on the basis of the detected current value of the current detector and a command current value, a hoist motor being driven by the A.C. output of the inverter; the operation of the inverter being stopped when a difference between the detected current value and command current value of the current detector for detecting the output current of the inverter exceeds a preset value. Accordingly, a current detector for detecting current flowing through the inverter is dispensed with, to realize a simple arrangement and a low cost.

8 Claims, 8 Drawing Figures

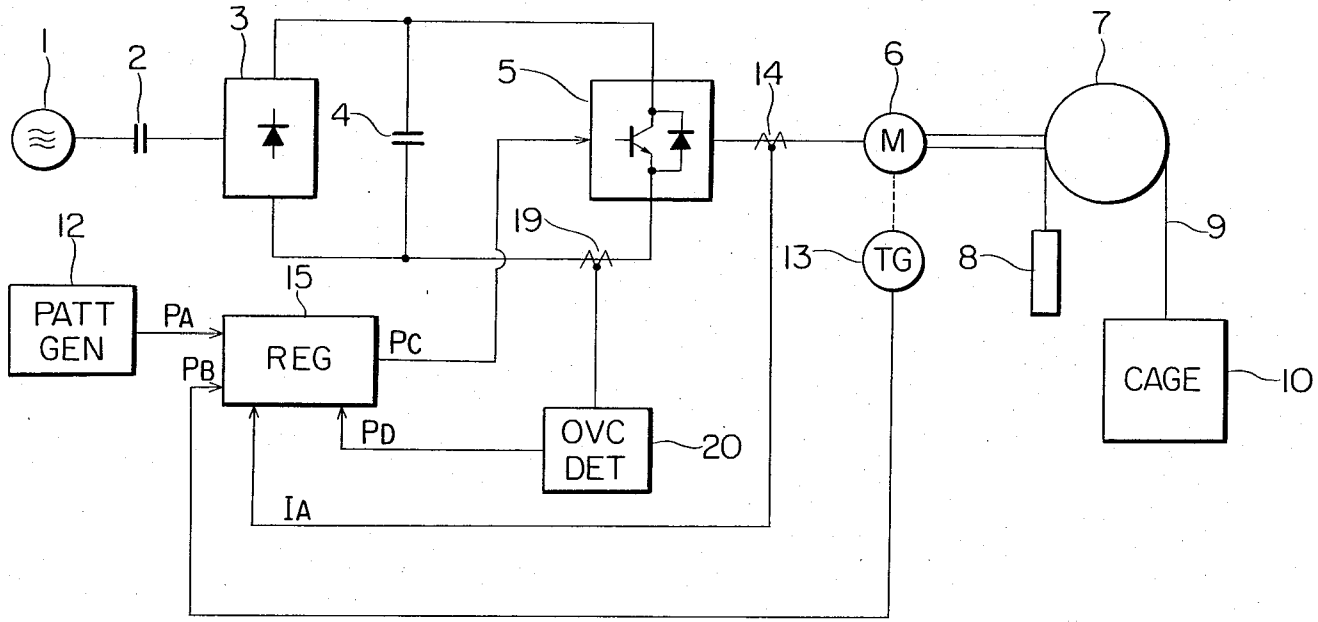
FIG. 1 PRIOR APT
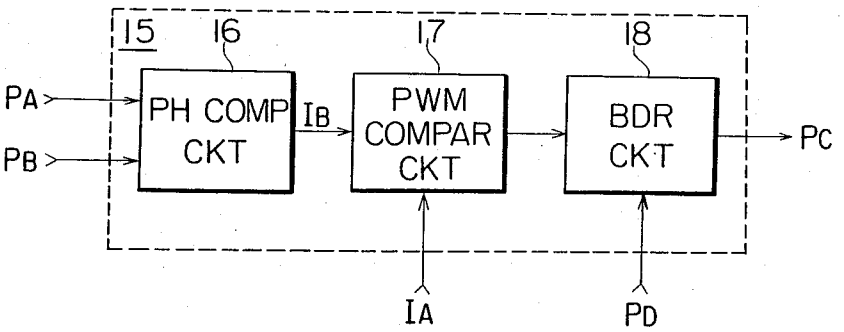
FIG. 2 PRIOR APT

SAFETY APPARATUS FOR ELEVATOR

BACKGROUND OF THE INVENTION

The present invention relates to a safety apparatus for an elevator in which a hoist motor is driven and controlled by a drive controller employing the so-called inverter.

In elevators, there has heretofore been an apparatus wherein an induction motor is used as a hoist motor for raising and lowering a cage and is driven and controlled by a drive controller employing an inverter.

Such apparatus for driving and controlling the elevator is as shown in FIG. 1 by way of example.

This drive and control apparatus is such that a three-phase A.C. output from a three-phase A.C. power source 1 is applied through a switch 2 to a converter 3, by which the three-phase A.C. output is converted into a D.C. output.

The D.C. output of the converter 3 is smoothed by a capacitor 4 and then applied to a transistor inverter 5. The D.C. output is inverted by the inverter 5 into a three-phase A.C. output, which is applied to a hoist motor 6 which is an induction motor so as to drive the motor.

Thus, a sheave 7 which is coupled to the rotary shaft of the hoist motor 6 is turned. A traction rope 9, which is wound round the sheave 7 and which has a balance weight 8 attached to one end thereof, has a cage 10 coupled to the other end thereof, so that the cage 10 ascends or descends with the turning of the sheave 7.

The apparatus further comprises: a regulator 15 which is an inverter controller which is supplied with a command velocity signal $P_A$ from a pattern generator 12 for generating a velocity pattern for the cage 10, a detected velocity signal $P_B$ from a tachometer generator 13 for detecting the rotational velocity of the hoist motor 6 and the running velocity of the cage 10, and a detected current signal $I_A$ which is a feedback signal from a current detector 14 for detecting the three-phase output current of the inverter 5.

Thus, the regulator 15 base-drives the respective transistors of the inverter 5 alternately on the basis of these input signals $P_A$, $P_B$ and $I_A$, to control the D.C. - A.C. change and to control the rotational velocity of the hoist motor 6 and, accordingly, the running velocity of the cage 10.

As shown by way of example in FIG. 2, the regulator 15 is composed of a phase compensation circuit 16 which compares and operates on the command velocity signal $P_A$ from the pattern generator 12 and the detected velocity signal $P_B$ from the tachometer generator 13, a PWM comparator circuit 17 which compares a command current signal $I_B$, which is the output of the phase compensation circuit 16, and the detected current signal $I_A$ from the current detector 14 and which provides a pulse width modulated pulse (PWM), and a base drive circuit 18 which is constructed of transistors etc. to be controlled "on" and "off" by the output pulses from the PWM comparator circuit 17 and which delivers a base drive signal $P_C$ to the inverter 5.

In such drive and control apparatus, when the current detector 14 for detecting the output current of the inverter 5 has malfunctioned, it fails to proyide the detected current signal $I_A$. Therefore, the regulator 15 continues to deliver the base drive signal $P_C$ for driving the respective transistors of the inverter 5 into the "on" state, and the output of the inverter 5 becomes saturated, so that the respective transistors of the inverter 5 may be damaged due to an overcurrent.

This drive and control apparatus is therefore further provided with safety device, namely, a current detector 19 which is disposed on a feeder line to the inverter 5 and which detects current flowing through the inverter 5, and an overcurrent detector 20 which supplies the base drive circuit 18 of the regulator 15 with an operation stopping signal $P_D$, namely, a signal for disabling the respective transistors of the base drive circuit 18 from turning "on", when the detected current value of the current detector 19 has exceeded preset value, that is, when an overcurrent flows through the inverter 5.

In this way, when an overcurrent flows through the inverter 5, the base drive signal $P_C$ is not delivered from the base drive circuit 18 of the regulator 15 to the respective transistors of the inverter 5, and the inverter 5 fails to operate, so that damage of the transitors of the inverter 5 can be prevented.

In such a case, however, the current detector for detecting the current flowing through the inverter is required separately from the current detector for detecting the output current of the inverter, which results in the drawbacks of a complicated arrangement and a high cost.

SUMMARY OF THE INVENTION

The present invention has been made in order to eliminate the problems described above, and has for its object to provide a safety apparatus for an elevator wherein an arrangement which stops an inverter at the detection of any fault by a current detector for detecting the output current of the inverter is simple and inexpensive.

The present invention consists in stopping the operation of an inverter when the difference between the detected current value and a command current value of a current detector for detecting the output current of the inverter has exceeded a preset value. Accordingly, a current detector for detecting current flowing through the inverter is disposed with, to realize a simple arrangement and a low cost.

BRIEF DESCRIPTION OF THE DRAWINGS

FIG. 1 is an arrangement diagram showing an example of a prior-art apparatus for driving and controlling an elevator;

FIG. 2 is a block diagram showing an example of a regulator in FIG. 1;

DESCRIPTION OF THE PREFERRED EMBODIMENT

An embodiment of the present invention will be described with reference to FIGS. 3 and 4 of the accompanying drawings. Portions corresponding to those in FIGS. 1 and 2 are assigned the same symbols, and shall be omitted from the following description.

Figure 3:
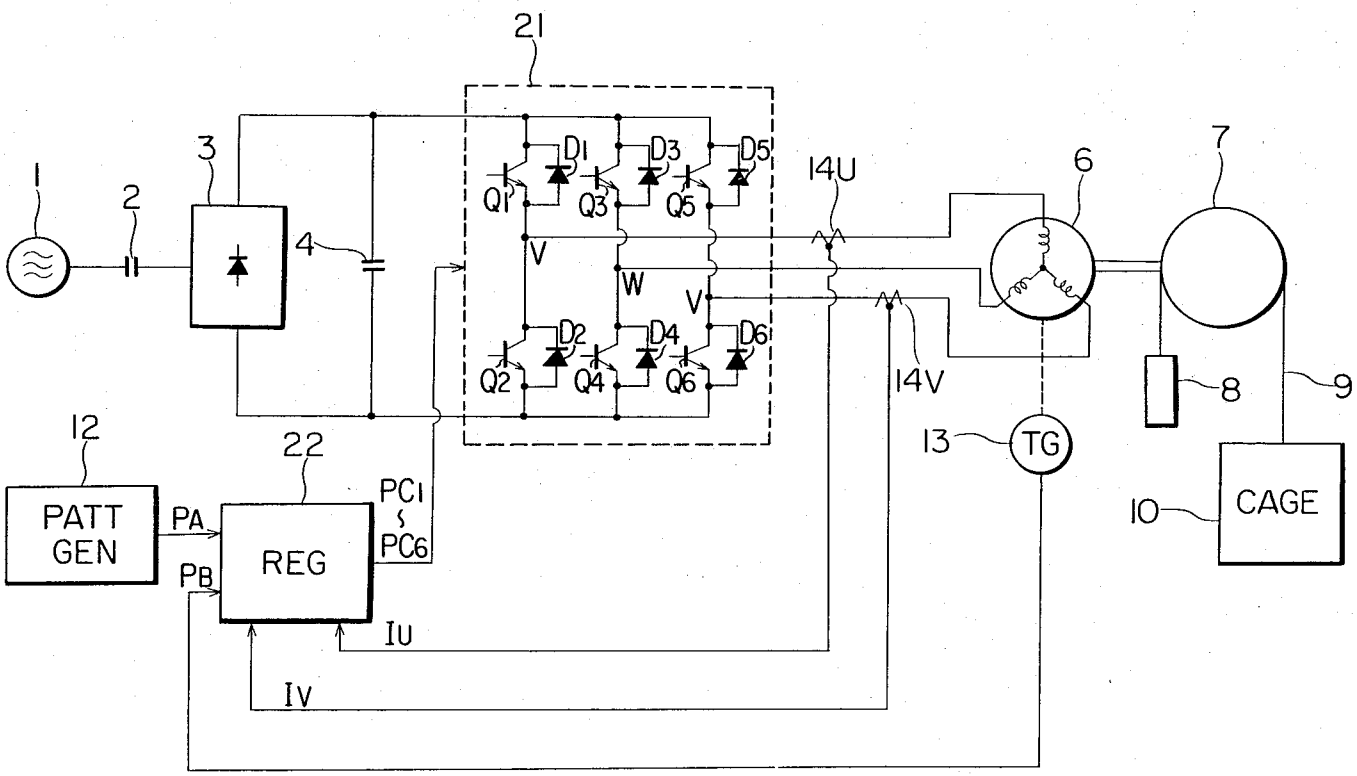
FIG. 3 is an arrangement diagram showing an embodiment of the present invention.

In FIG. 3, an inverter 21 is composed of six transistors $Q_1$–$Q_6$ and diodes $D_1$–$D_6$, etc. The inverter 21 inverts the D.C. output of the converter 3 into a three-phase A.C. output U, V and W which are connected to the hoist motor 6. The transistors $Q_1$–$Q_6$ are base-driven by six base drive signals $P_{C1}$–$P_{C6}$ from a regulator 22 being an inverter controller to be described later.

While the inverter 21 is a transistor inverter, it may well be constructed of, for example, a thyristors.

Current detectors 14U and 14V which are formed of, e.g., current transformers are disposed on the feeder lines of the U-shaped and V-phase of the three-phase A.C. output of the inverter 21, respectively. They supply the regulator 22 with detected current signals $I_U$ and $I_V$ which correspond to the output currents of the U-phase and V-phase, respectively.

Figure 4:
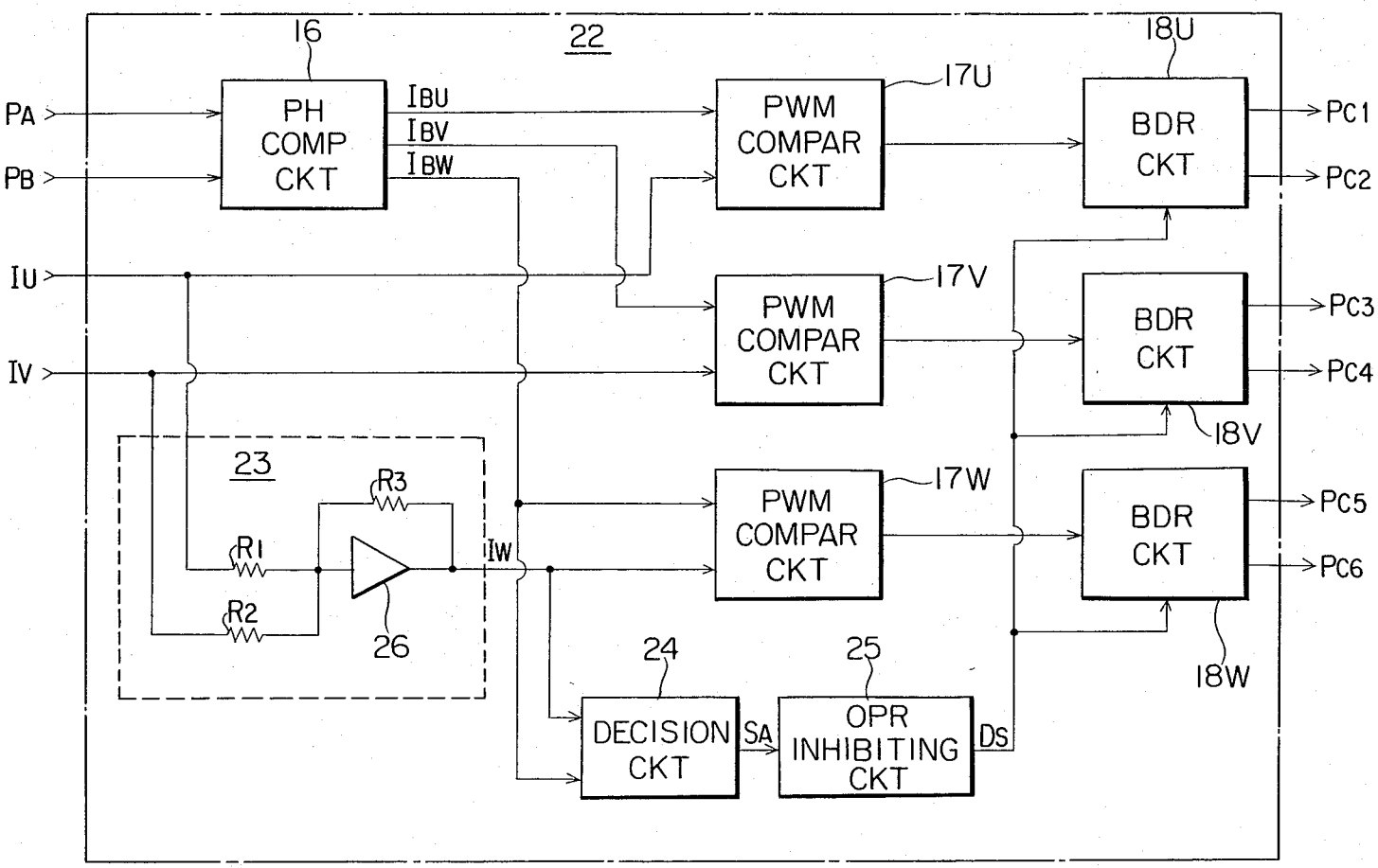
FIG. 4 is a block diagram showing an example of a regulator in FIG. 3.

As shown in FIG. 4, the regulator 22 is composed of the phase compensation circuit 16, respective PWM comparator circuits 17U, 17V and 17W and base drive circuits 18U, 18V and 18W for the U-phase, V-phase and W-phase, an adder circuit 23 for creating a detection current signal for the W-phase, a decision circuit 24, and an operation inhibiting circuit 25.

The adder circuit 23 consists of resistors $R_1$ and $R_2$ which receive the respective detection current signals $I_U$ and $I_V$ of the U- and V-phases from the current detectors 14U and 14V in FIG. 3, a feedback resistor $R_3$, and an amplifier 26. Ot °rpvodes tje added value of the detection current signals $I_U$ and $I_V$ as the W-phase detection current signal $I_W$.

The decision circuit 24 receives as its inputs a command current signal $I_{BW}$ from the phase compensation circuit 16 and the detected current signal $I_W$ from the adder circuit 23, namely, a command current value and a detected current value. It decides whether or not the difference between the detected current signal $I_W$ and the command current signal $I_{BW}$ exceeds a preset value. When the difference has exceeded the set value, the decision circuit provides a decision signal $S_A$ (of, for example, high level "H").

By way of example, the set value may be set at a current value smaller than a current value which corresponds to the difference between the maximum value of the composite current of the respective currents of the U- and V-phases and the maximum current of the current of the U-phase (or V-phase).

The operation inhibiting circuit 25 provides an operation inhibiting signal $D_S$ for disabling the base drive circuits 18U, 18V and 18W which operates, upon receiving the decision signal $S_A$ from the decision circuit 24.

The operation inhibiting circuit 25 is constructed of a transistor or the like which goes into the "on" state when the decision signal $S_A$ from the decision circuit 24 becomes high level "H" by way of example. It is arranged so as to disable the transistors of the respective base drive circuits 18U, 18V and 18W by turnning the respective transistors "on" (or "off").

The respective PWM comparator circuits 17U, 17V and 17W compare command current signals $I_{BU}$, $I_{BV}$ and $I_{BW}$ from the phase compensation circuit 16 with the detected current signals $I_U$, $I_V$ and $I_W$, respectively, and provide PWM pulses (pulse width modulation). The respective base drive circuits 18U, 18V and 18W deliver the base drive signals $P_{C1}$–$P_{C6}$ to the inverter 21.

Owing to such arrangement, when at least either of the U-phase current detectors 14U or the V-phase current detector 14V in FIG. 3 has malfunctioned, the maximum current value of the W-phase detection current signal $I_W$ which is the addition output value of the adder circuit 23 in FIG. 4 which adds the respective detection current signals $I_U$ and $I_V$ of the current detectors 14U and 14V becomes only the maximum current value of the detection current $I_U$ or $I_V$.

Therefore, the difference between the command current signal $I_{BW}$ from the phase compensation circuit 16 and the aforementioned detection current signal $I_W$ exceeds the set value, the decision signal $S_A$ is issued by the decision circuit 24, and the operation inhibiting circuit 25 inhibits the operation of any of the base drive circuits 18U, 18V and 18W.

Accordingly, the inverter 21 stops operating, and no overcurrent flows therethrough, so that the respective transistors thereof can be prevented from being damaged.

In this manner, by utilizing the safety apparatus of this embodiment, the outputs of the current detectors which detect the output currents of the inverter 21 are also used for detecting the overcurrent, and hence, any current detector for detecting the overcurrent of the inverter need not be separately disposed, so that the apparatus becomes simple in arrangement and low in cost.

As in the embodiment described above a malfunction, of each current detector can be detected by deciding whether or not the difference between the added value of the respective detection current values of the current detectors provided in the two phases in the three-phase A.C. outputs and the command current value of the phase provided with no current detector exceeds the preset value. Therefore, one decision circuit suffices, to render the apparatus simpler in arrangement and lower in cost.

Figure 5:
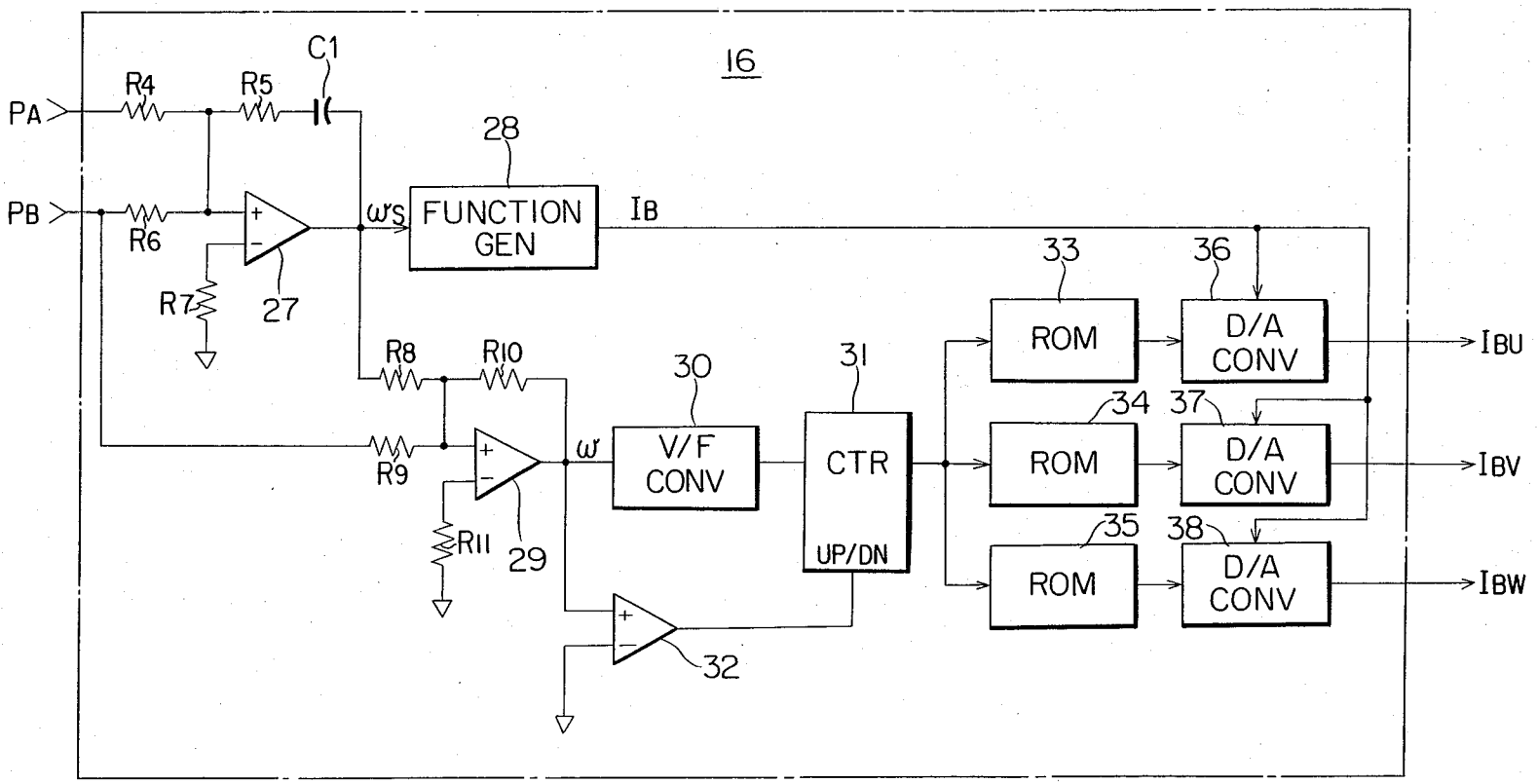
FIG. 5 is an electric circuit diagram showing the arrangement of a phase compensation circuit in FIG. 4.
Figure 6:
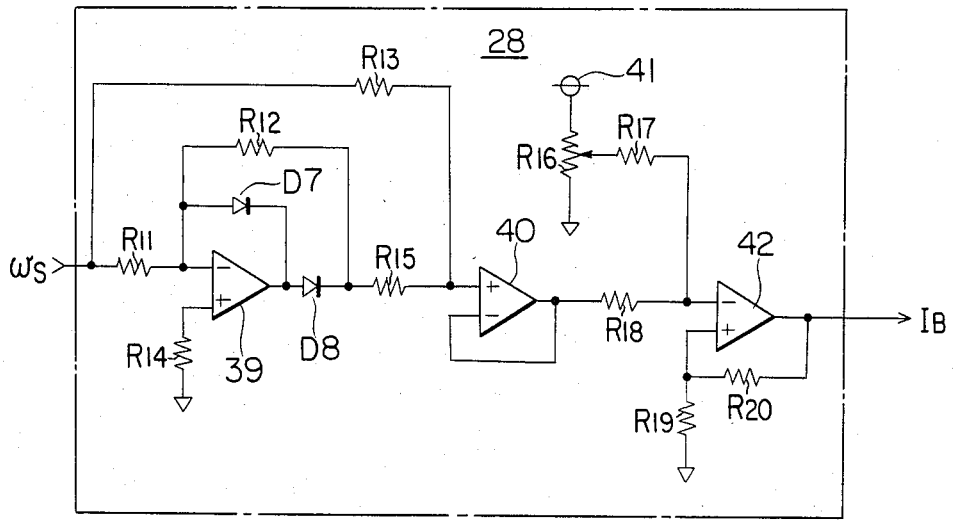
FIG. 6 is an electric circuit diagram showing the arrangement of a function generator in FIG. 5.

FIG. 5 is a detailed diagram of the phase compensation circuit 16 in FIG. 4. The phase compensation circuit receives as its inputs the command velocity signal $P_A$ from the pattern generator 12 and the detected velocity signal $P_B$ from the tachometer generator 13 in FIG. 3. A circuit composed of resistors R4–R7, a capacitor C1 and an operational amplifier 27 performs the PI control operation of the deviation of both the input signals, and provides a slip frequency command ($\omega_s$) Numeral 28 designates a function generator which receives the slip frequency command ($\omega_s$) and generates a primary current command value $I_B$ in correspondence therewith. The circuit details of this function generator are shown in FIG. 6. The slip frequency command ($\omega_s$) is added to the detected velocity signal $P_B$ from the tachometer generator 13 by an adder circuit composed of resistors R8–R9 and an operational amplifier 29, to become a frequency command ($\omega$). The frequency command ($\omega$) is converted into a train of pulses by a V/F converter 30. The converted train of pulses are up- or down-counted by a counter 31. The counting direction is determined by the output signal of a comparator 32 through which the polarity of the frequency command ($\omega$) is compared. Shown at numerals 33–35 are read-only memories (hereinbelow, abbreviated to "ROMs"), which are addressed by the output of the counter 31 and generate sinusoidal outputs corresponding to the address output and having phase differences of 120° in terms of digital magnitudes. The outputs of the ROMs 33–35 are multiplied by the output $I_B$ of the function generator 28 by means of D/A converters 36–38, so that the instantaneous current command values $I_{BU}$, $I_{BV}$ and $I_{BW}$ having analog magnitudes are provided.

FIG. 6 shows a practicable circuit arrangement of the function generator 28 in FIG. 5. In the slip frequency control, the relationship of the following equation holds between the slip frequency ($\omega_s$) and the primary current value ($I_B$):

$$I_B = I_M\sqrt{1 + \left(\frac{L_2}{R_2}\,\omega_s\right)^2}$$

where $I_M$: exciting current component,
$L_2$: rotor inductance,
$R_2$: rotor resistance.

The function generator 28 closely realizes the above equation. In FIG. 6, a circuit composed of resistors R11–R15, diodes D7, D8 and operational amplifiers 39, 40 is an absolute value calculating circuit, by which irrespective of the porality of the input slip frequency $\omega_s$, a plus value of equal absolute value is provided. A circuit composed of a power source 41, resistors R16–R20 and an operational amplifier 42 is an adder circuit, by which a fixed voltage determined by the setting of the resistor R16 is added to the output of the operational amplifier 40. The output of the adder circuit becomes the current command $I_B$.

Figure 7:
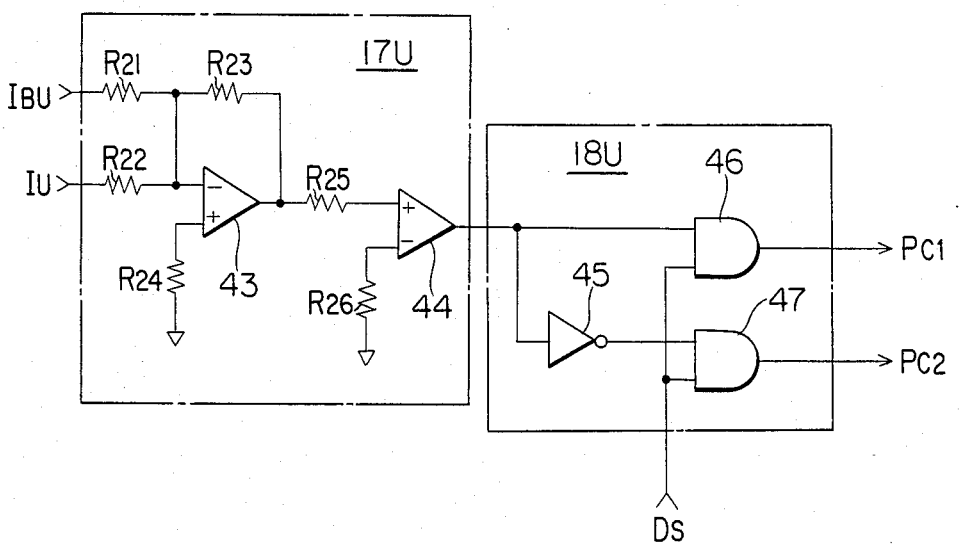
FIG. 7 is an electric circuit diagram showing the arrangement of a PWM comparator circuit as well as a base drive circuit in FIG. 4.

FIG. 7 shows the circuit arrangements of the PWM comparator circuit 17U and the base drive circuit 18U in FIG. 4.

The difference between the instantaneous current command value $I_{BU}$ of the U-shaped and the output $I_U$ of the current detector 14U is calculated by a subtracter circuit composed of resistors R21–R23 and an operational amplifier 43, and it is passed through a comparator composed of resistors R25, R26 and an operational amplfier 44. Thus, the output of the operational amplifier 44 becomes an H level when the sign of the output of the operational amplifier 43 is plus, and it becomes an L level when the sign is minus.

The logical product between the output of the operational amplifier 44 and the output $D_S$ of the operation inhibiting circuit 25 is obtained by an AND circuit 46, and it is provided as the base signal $P_{C1}$ of the transistor Q1. In addition, the output signal of the operational amplifier 44 is inverted through an inverter circuit 45. The logical product between the inverted signal and the output $D_S$ of the operation inhibiting circuit 25 is obtained by an AND circuit 47, and it is provided as the base signal $P_{C2}$ of the transistor Q2. Regarding the V- and W-phases, the base signals $P_{C3}$–$P_{C6}$ are provided by the same circuits as the circuit of the U-phase.

Figure 8:
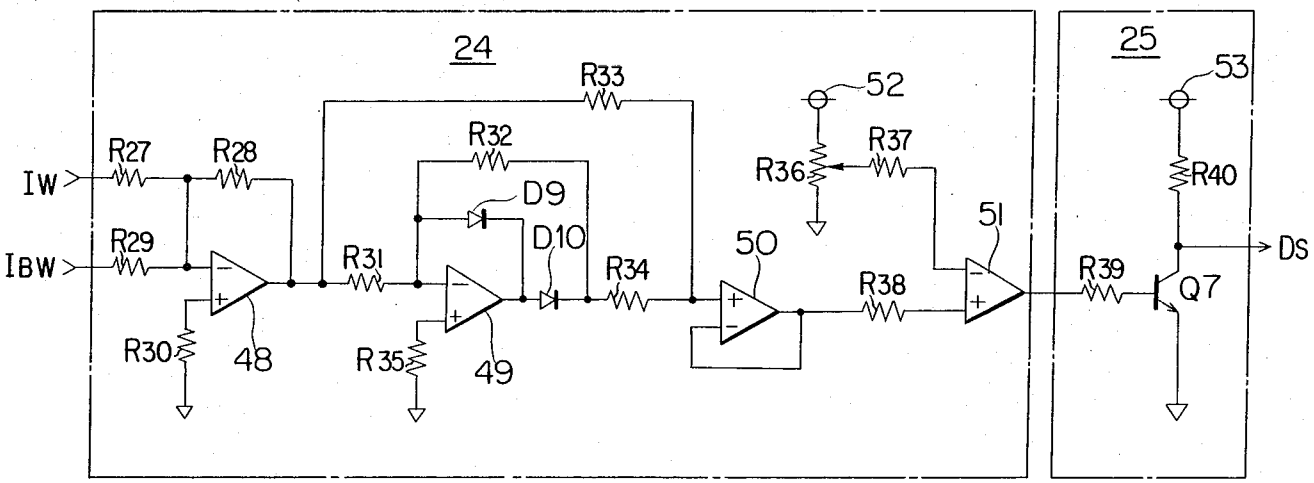
FIG. 8 is an electric circuit diagram showing the arrangement of a decision circuit as well as an operation inhibiting circuit in FIG. 4.

FIG. 8 shows the details of the decision circuit 24 and the operation inhibiting circuit 25. The deviation between the current command signal $I_{BW}$ and the output $I_W$ of the adder circuit 23 is obtained by a subtracter circuit composed of resistors R27–R30 and an operational amplifier 48. The obtained value is changed to an absolute value through an absolute value calculating circuit which is composed of resistors R31–R35, diodes D9, D10 and operational amplifiers 49, 50. A comparator composed of an operational amplifier 51, resistors R36–R38 and a power source 52 compares the output of the operational amplifier 50 and a detection level determined by the set value of the resistor R36. When the output of the operational amplifier 50 has become greater than the detection level, the output of the operational amplifier 51 becomes the H level to turn "on" a transistor Q7 of the operation inhibiting circuit 25 at the succeeding stage. Then, the operation inhibiting signal $D_S$ is brought to the L level to prevent the signals of the base drive circuits 18U, 18V and 18W from being provided.

What is claimed is:

1. In an elevator having a converter which changes an A.C. output from an A.C. power source into a D.C. output, an inverter which changes the D.C. output of the converter into an A.C. output, a current detector which detects an output current of the inverter, and an inverter controller which controls the inverter on the basis of the detected current value of the current detector and a command current value, a hoist motor being driven by the A.C. output of the inverter; a safety apparatus for an elevator characterized by comprising decision means to decide whether or not a difference between the detect current value of said current detector and the command current value exceeds a preset value, and operation inhibition means to inhibit the operation of said inveter when said decision means has decided that the difference between the detected current value and the command current value exceeds the set value.

2. A safety apparatus for an elevator as defined in claim 1, wherein said A.C. power source is a three-phase A.C. power source, said inverter provides a three-phase A.C. output, the output currents of two phases in the three-phase A.C. outputs of said inverter are respectively monitored by the current detectors, and said controller calculates a detection value of the other one phase on the basis of the detected values of the two phases.

3. A safety apparatus for an elevator as defined in claim 2, wherein said controller generates signals for controlling said inverter, by comparing the detected values of the two phases by said current detectors and the calculated value of the other one phase with the command current values given to the respective phases.

4. A safety apparatus for an elevator as defined in claim 2, wherein the calculation of the detection value of the other one phase is performed by adding the detected values of the two phases.

5. A safety apparatus for an elevator as defined in claim 2, wherein when the difference between the calculated value and command current value of the other one phase has become greater than the preset value, said decision means determines that an abnormal condition exists and provides a decision signal therefor.

6. A safety apparatus for an elevator as defined in claim 5, wherein said preset value is smaller than a current value which corresponds to a difference between a maximum value of a combined current of the respective currents of the two phases and a maximum value of the current of either of the two phases.

7. A safety apparatus for an elevator as defined in claim 2, wherein when said decision means has provided an output signal indicative of an abnormal condition as the result of the deciding operation, said operation inhibition means receives this output signal and generates a signal for stopping generation of an operation control signal which said controller supplies to said inverter.

8. A safety apparatus for an elevator as defined in claim 7, wherein the signal generated by said operation inhibition means causes said controller to stop the generation of the operation control signals of all the phases.

* * * * *